US011440037B1

(12) United States Patent
Brookins

(10) Patent No.: US 11,440,037 B1
(45) Date of Patent: Sep. 13, 2022

(54) PORTABLE MIST WAND SYSTEM

(71) Applicant: ZAP MOSQUITO SOLUTIONS INC., Miami, FL (US)

(72) Inventor: Keith Donald Brookins, Miami, FL (US)

(73) Assignee: ZAP MOSQUITO SOLUTIONS INC., Miami, FL (US)

( * ) Notice: Subject to any disclaimer, the term of this patent is extended or adjusted under 35 U.S.C. 154(b) by 0 days.

(21) Appl. No.: 17/693,055

(22) Filed: Mar. 11, 2022

(51) Int. Cl.

| | |
|---|---|
| ***B05B 9/04*** | (2006.01) |
| ***B05B 15/58*** | (2018.01) |
| ***B05B 9/01*** | (2006.01) |
| ***B05B 9/08*** | (2006.01) |

(52) U.S. Cl.
CPC ..... *B05B 9/0403* (2013.01); *B05B 9/01* (2013.01); *B05B 9/0861* (2013.01); *B05B 15/58* (2018.02)

(58) Field of Classification Search
CPC ..... B05B 9/0403; B05B 9/01; B05B 9/0855; B05B 9/0861; B05B 12/002; B05B 15/58
USPC ..... 239/124, 127, 332, 525, 530, 532
See application file for complete search history.

(56) References Cited

U.S. PATENT DOCUMENTS

| | | | | |
|---|---|---|---|---|
| 3,904,116 | A * | 9/1975 | Jones | B05B 9/0866 239/332 |
| 4,925,105 | A * | 5/1990 | Lin | B05B 9/0861 239/332 |
| 7,631,818 | B2 * | 12/2009 | Wu | B60S 1/66 239/332 |
| 10,028,497 | B1 | 7/2018 | Brookins | |
| 10,799,838 | B1 | 10/2020 | Brookins | |
| 10,799,839 | B1 | 10/2020 | Brookins | |
| 2007/0278326 | A1 * | 12/2007 | Wu | H01M 50/209 239/332 |
| 2012/0319309 | A1 | 12/2012 | Sorola et al. | |

* cited by examiner

*Primary Examiner* — Steven J Ganey
(74) *Attorney, Agent, or Firm* — Albert Bordas, P.A.

(57) ABSTRACT

A portable mist wand system, which has a housing assembly, a tank assembly, a handle assembly, a battery assembly, a pump motor assembly, a wand panel assembly, a wand assembly, and a solenoid assembly. The housing assembly has a front panel, a rear panel, a top panel, a bottom panel, and lateral panels. The tank assembly is secured to the top panel and trapped by the front panel, the handle assembly is mounted onto the top panel, the battery assembly is secured to the top panel, the pump motor assembly is secured to the rear panel, the wand panel assembly is mounted onto the front panel, and the solenoid assembly is mounted onto the bottom panel. The housing assembly houses the tank assembly, the battery assembly, the pump motor assembly, and the solenoid assembly.

19 Claims, 7 Drawing Sheets

PORTABLE MIST WAND SYSTEM

BACKGROUND OF THE INVENTION

1. Field of the Invention

The present invention relates to misting systems, and more particularly, to portable mist wand systems.

2. Description of the Related Art

Applicant believes that one of the closest references corresponds to Applicant's own U.S. Pat. No. 10,028,497 B1 issued to Keith Donald Brookins on Jul. 24, 2018 for Misting system. However, it differs from the present invention because Brookins teaches a misting system having an external compartment, an interior housing, a container housing, an electrical compartment, a lid assembly, and at least one outlet. The external compartment has a top face with a hole, a cavity, and an electrical cover panel. The interior housing has a top face with a hole, and lateral faces with a respective pivot hole. The container housing has lateral faces having pivoting protrusions, which are positioned onto each pivot hole of the interior housing lateral faces. The electrical compartment has a cover panel, a battery and a pump assembly. The lid assembly has a locking tab, a panel locking tab, a latching-limiter rod, and a spear. The electrical cover panel of the external compartment mounts onto the electrical compartment, and the cover panel of the electrical compartment mounts onto the external compartment. The lid assembly covers the external compartment and the electrical compartment.

Applicant believes that another reference corresponds to Applicant's own U.S. Pat. No. 10,799,838 B1 issued to Keith Donald Brookins on Oct. 13, 2020 for Multifunctional misting system. However, it differs from the present invention because Brookins teaches a multifunctional misting system having a housing assembly, a frame assembly, a recessed mist blower assembly, a valve assembly, a recess control panel assembly, a pump-motor assembly, a tank assembly, a puck assembly, and a handle assembly. The housing assembly has first and second flat panels, a front panel, a rear panel, a top panel, a bottom panel, and locking corners. The frame assembly has a solenoid side frame and a blower side frame, a mix solenoid, and a battery with a battery retainer. The recessed mist blower assembly has a blower and nozzles. The pump-motor assembly has a pump motor, a pump housing and a motor-battery bracket. The handle assembly is positioned onto the top panel of the housing assembly. The multifunctional misting system may operate as a mist blower.

Applicant believes that another reference corresponds to Applicant's own U.S. Pat. No. 10,799,839 B1 issued to Keith Donald Brookins on Oct. 13, 2020 for Multifunctional misting system. However, it differs from the present invention because Brookins teaches a multifunctional misting system having a housing assembly, a frame assembly, a mist blower assembly, a valve assembly, a recess control panel assembly, a pump-motor assembly, a tank assembly, and a handle assembly. The housing assembly has first and second flat panels, a front panel, a rear panel, a top panel, a bottom panel, and locking corners. The frame assembly has first and second frames, and a battery with a battery retainer. The mist blower assembly has a blower and nozzles. The pump-motor assembly is a motor attached to a pump. The motor has a motor-battery bracket fixed to the motor and a spacer. The handle assembly is positioned onto the top panel of the housing assembly. The multifunctional misting system may operate as a mist blower.

Applicant believes that another reference corresponds to U.S. Patent Publication No. 20120319309 A1 issued to Sorola; et al. on Dec. 20, 2012 for Rechargeable, Portable, Misting Beverage System. However, it differs from the present invention because Sorola; et al. teach a misting system utilizing spent ice that comprises a portable housing and an inner frame. The inner frame is secured inside the housing and is configured to receive ice and at least one of food and beverage. The inner frame has an outlet for passing the melted ice. A lid is provided for selectively enclosing the inner frame. The system includes a pump. The pump is inside the portable housing and is in communication with the inner frame outlet and an outlet of the portable housing. The pump is configured to pump melted ice from the inner frame to the outlet of the portable housing for use as mist.

Other patents describing the closest subject matter provide for a number of more or less complicated features that fail to solve the problem in an efficient and economical way. None of these patents suggest the novel features of the present invention.

SUMMARY OF THE INVENTION

The present invention is a portable mist wand system, comprising a housing assembly, a tank assembly, a handle assembly, a battery assembly, a pump motor assembly, a wand panel assembly, a wand assembly, and a solenoid assembly.

The housing assembly comprises a front panel, a rear panel, a top panel, a bottom panel, and lateral panels. The tank assembly is secured to the top panel and trapped by the front panel, the battery assembly is secured to the top panel, the handle assembly is mounted onto the top panel, the pump motor assembly is secured to the rear panel, the wand panel assembly is mounted onto the front panel, and the solenoid assembly is mounted onto the bottom panel. The housing assembly houses the tank assembly, the battery assembly, the pump motor assembly, and the solenoid assembly. The housing assembly further comprises corners, strap loops, air intake holes on the lateral panels, and feet on the bottom panel.

The front panel defines a wand panel cavity, a mix switch hole, a power switch hole, and a charge port hole. The top panel comprises a tank neck hole and a fuse hole. The wand panel cavity receives the wand panel assembly, the mix switch hole receives a mix switch, the power switch hole receives a power switch, and the charge port hole receives a charge port.

The tank assembly comprises a tank body having a tank outlet, a tank upper section having a tank inlet to receive a mix tube, a tank neck, a tank strainer, a tank cap having a cap vent, a tank mounting flange, and a top flange. The tank neck passes through the tank neck hole and protrudes from the top panel to receive the tank cap.

The handle assembly comprises a handle body, a handle top, a handle grip, and a mist switch. The battery assembly comprises a battery, a control board, a fuse, a battery mounting bracket, and screws.

The fuse passes through the fuse hole and protrudes from the top panel. The battery, the tank assembly, and the handle assembly are secured to the top panel with the mounting screws, whereby a leg of the battery mounting bracket and the top flange are fixed together to the top panel by the mounting screws.

The pump motor assembly comprises a pump, a pump output with a pump output tube, a pump input with a pump input tube, and a motor. The motor is secured to the rear panel with a motor bracket and a motor spacer is between the motor and the bottom panel.

The wand panel assembly comprises a wand panel having a central hole to receive a bulkhead union secured with a bulkhead union nut. The wand assembly comprises a wand tube, a wand handle, a wand nozzle, wand tubing connector, and a wand tubing having first and second ends. The wand tubing extends from the wand panel assembly to the wand assembly, whereby the first end is connected to the bulkhead union and the second end is connected to the wand tubing connector. The wand assembly is secured onto the top panel with at least one wand clip.

The solenoid assembly comprises a solenoid valve, first and second solenoid input connectors, a solenoid output connector, and a main output tube. The solenoid assembly allows for a return fluid path for mixing and purge air when the mix switch is depressed. The solenoid assembly drops the main output tube pressure upon the mist switch release allowing for dripless operation.

The mix tube extends from the tank inlet to the solenoid output connector and the pump input tube extends from the tank outlet to the pump input. The main output tube extends from the second solenoid input connector to the bulkhead union.

It is therefore one of the main objects of the present invention to provide a portable mist wand system.

It is another object of this invention to provide a portable mist wand system having a wand assembly.

It is another object of this invention to provide a portable mist wand system, which has a wand panel assembly to connect the wand assembly.

It is another object of this invention to provide a portable mist wand system in which the misting is at a constant pressure, without the need for pumping.

It is another object of this invention to provide a portable mist wand system, which has a solenoid assembly that provides purging, mixing, and anti-drip.

It is another object of this invention to provide a portable mist wand system that has quiet operation.

It is another object of this invention to provide a portable mist wand system that is designed to be light weight.

It is another object of this invention to provide a portable mist wand system that is volumetrically efficient for carrying, transporting, and storage.

It is another object of this invention to provide a portable mist wand system that can be readily assembled and disassembled without the need of any special tools.

It is another object of this invention to provide a portable mist wand system, which is of a durable and reliable construction.

It is yet another object of this invention to provide a portable mist wand system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
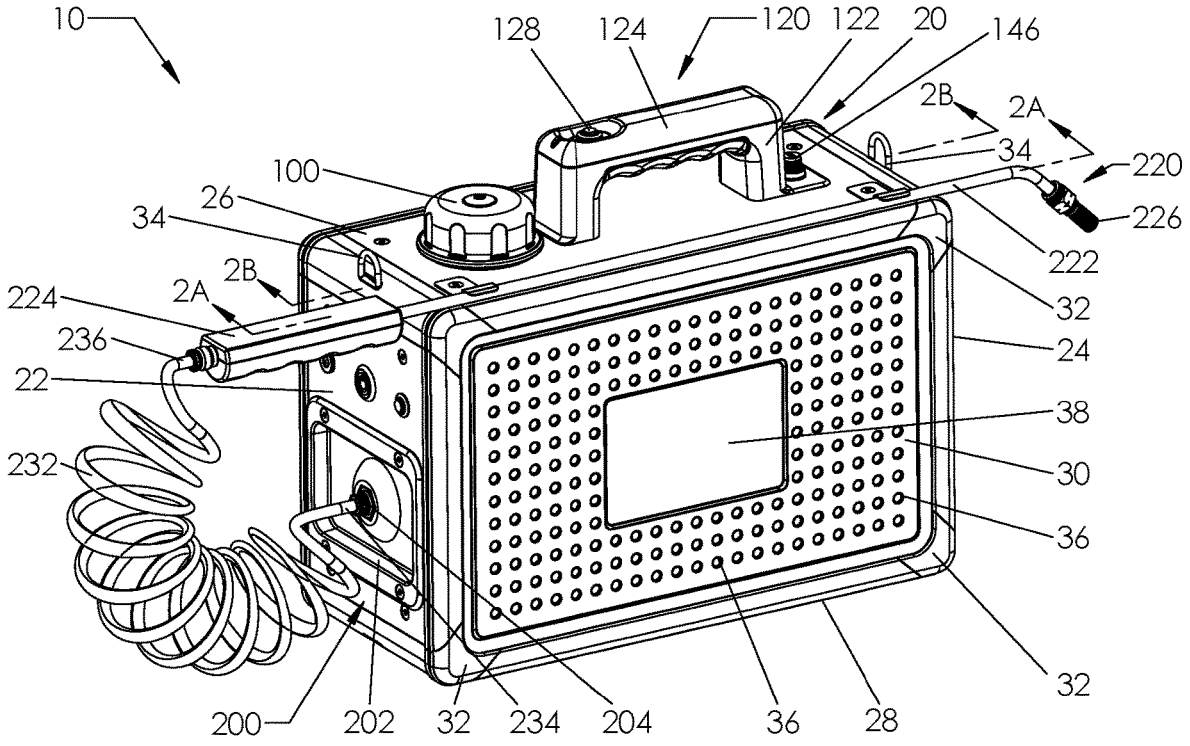
FIG. 1A is a front isometric view of the present invention.

Referring now to the drawings, the present invention is a portable mist wand system and is generally referred to with numeral 10. It can be observed that it basically includes housing assembly 20, tank assembly 90, handle assembly 120, battery assembly 140, pump motor assembly 160, wand panel assembly 200, wand assembly 220, and solenoid assembly 250.

Figure 1B:
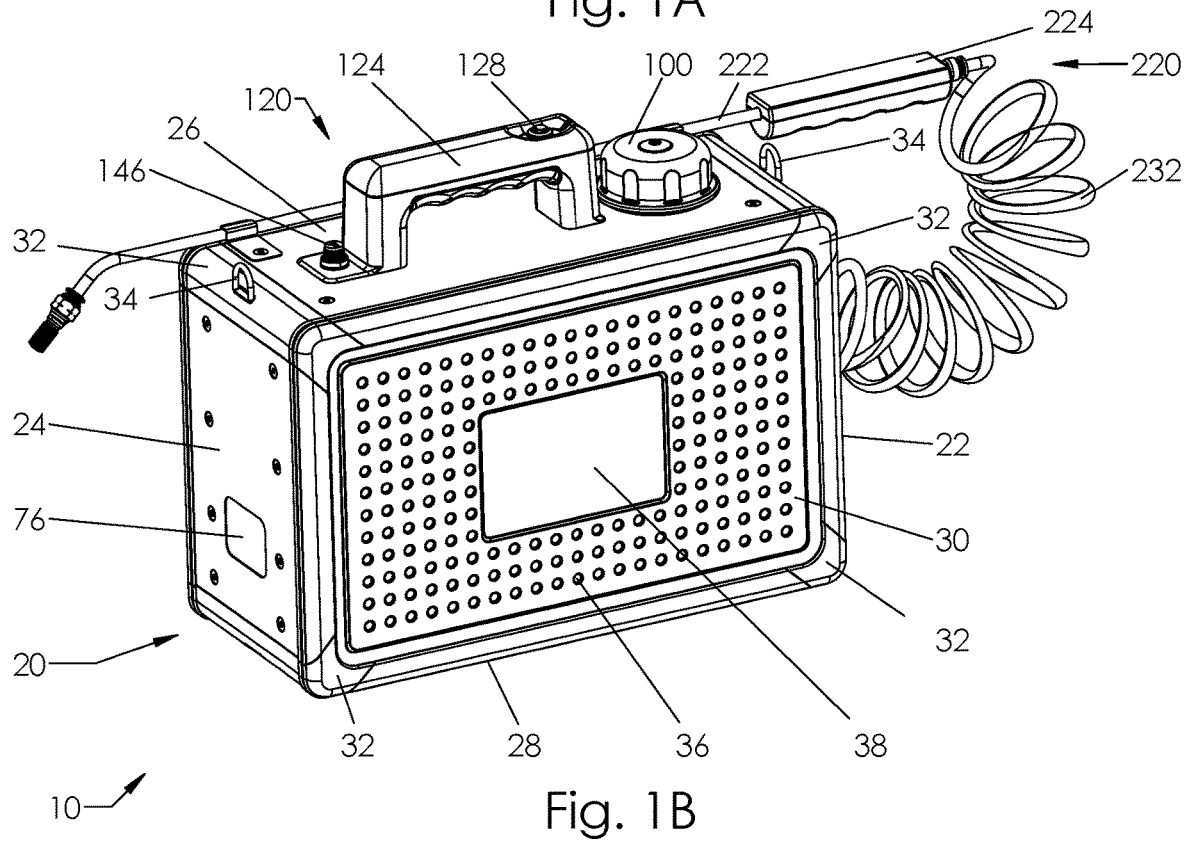
FIG. 1B is a rear isometric view of the present invention.

As seen in FIGS. 1A and 1B, housing assembly 20 comprises front panel 22, rear panel 24, top panel 26, bottom panel 28, and lateral panels 30. Housing assembly 20 further comprises corners 32. Corners 32 connect front panel 22 and rear panel 24, to top panel 26 and bottom panel 28. Corners 32 joined to top panel 26 comprise first and second strap loops 34. Lateral panels 30 comprises air intake holes 36. Air intake holes 36 are designed to prevent rodent and/or insect intrusion while providing adequate air intake. In a preferred embodiment, lateral panels 30 comprise solid area 38 approximately at a center, and rear panel 24 comprises information area 76. Handle assembly 120 and wand assembly 220 are mounted onto top panel 26. Wand panel assembly 200 is mounted onto front panel 22.

Present invention 10 is a portable mist wand system for solutions. Such solutions can be, but are not limited to, anti-pathogen agents, insect controls whether adult or pre-emergent including mosquitoes, bed bugs, lice, and mites. The solution further includes insect repellents, extermination treatments, plant health fertilizers, insecticides, fungicides, surfactants for drought resistance in public health applications, mold mitigation, sunscreen, sanitation products such as sanitizers and anti-pathogens, and odor controllers such as deodorizers and fragrances.

Figure 2A:
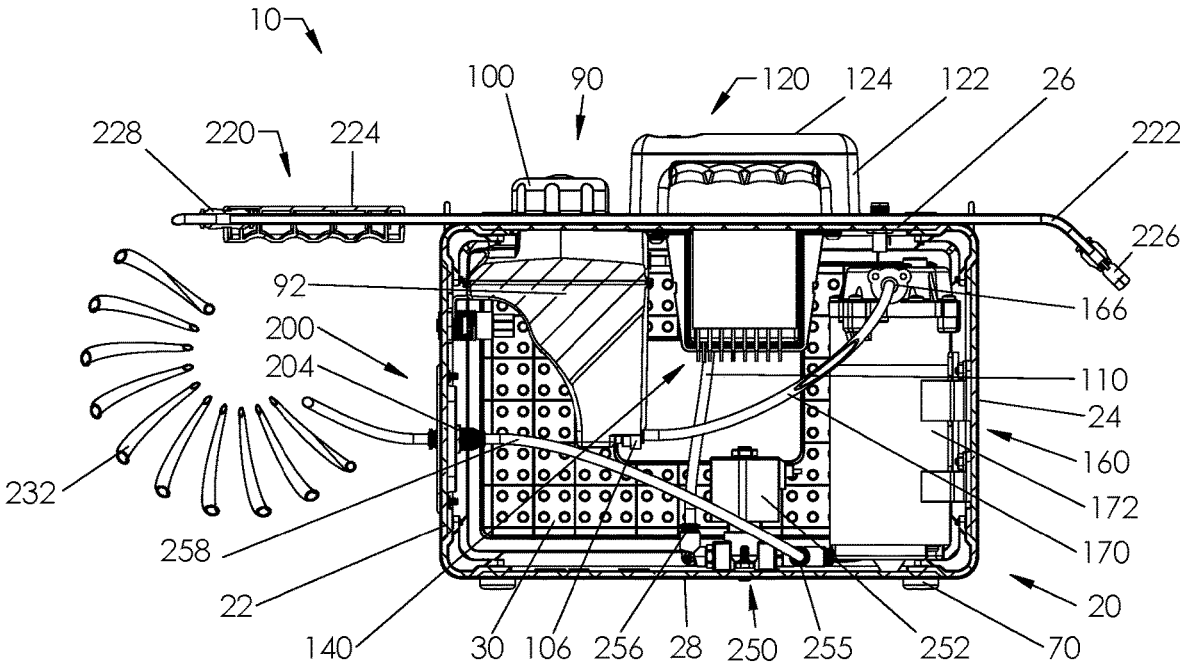
FIG. 2A is a cut view taken along line 2A-2A from FIG. 1A.
Figure 2B:
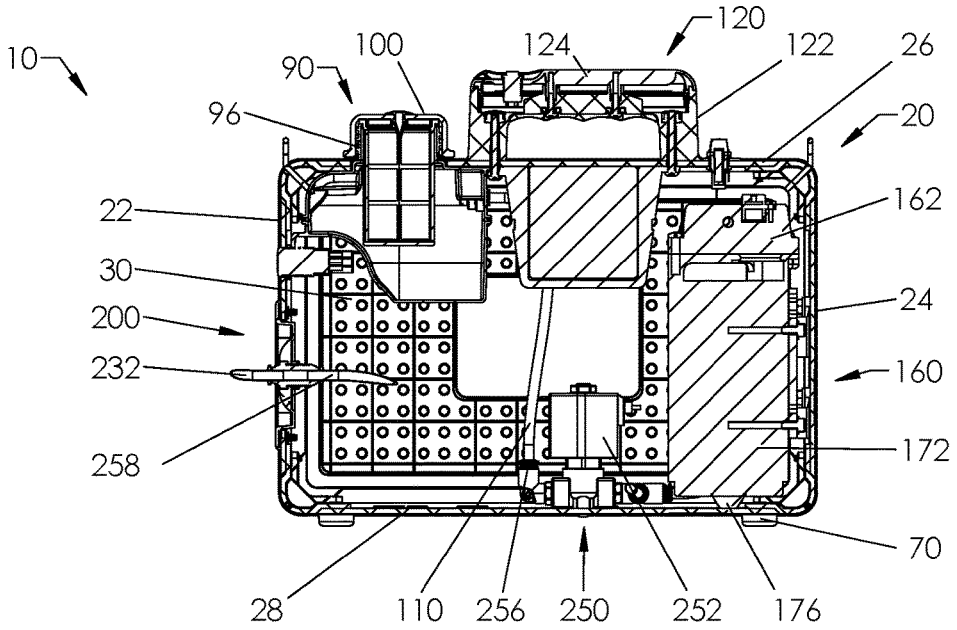
FIG. 2B is a cut view taken along line 2B-2B from FIG. 1A.

As seen in FIGS. 2A and 2B, housing assembly 20 houses tank assembly 90, battery assembly 140, pump motor assembly 160, and solenoid assembly 250. Mix tube 110 extends from tank inlet 108, seen in FIG. 5, to solenoid output connector 256. Pump input tube 170 extends from tank outlet 106 to pump input 166. Main output tube 258 extends from solenoid input connector 255 to bulkhead union 204. Solenoid valve 252 discharges main output tube 258 pressure upon mister deactivation dropping line pressure for anti-drip. Solenoid valve 252 and pump motor assembly 160 are both activated through mist switch 58, seen in FIG. 4, allowing a fluid path to tank body 92 through mix tube 110 for mixing.

Figure 3:
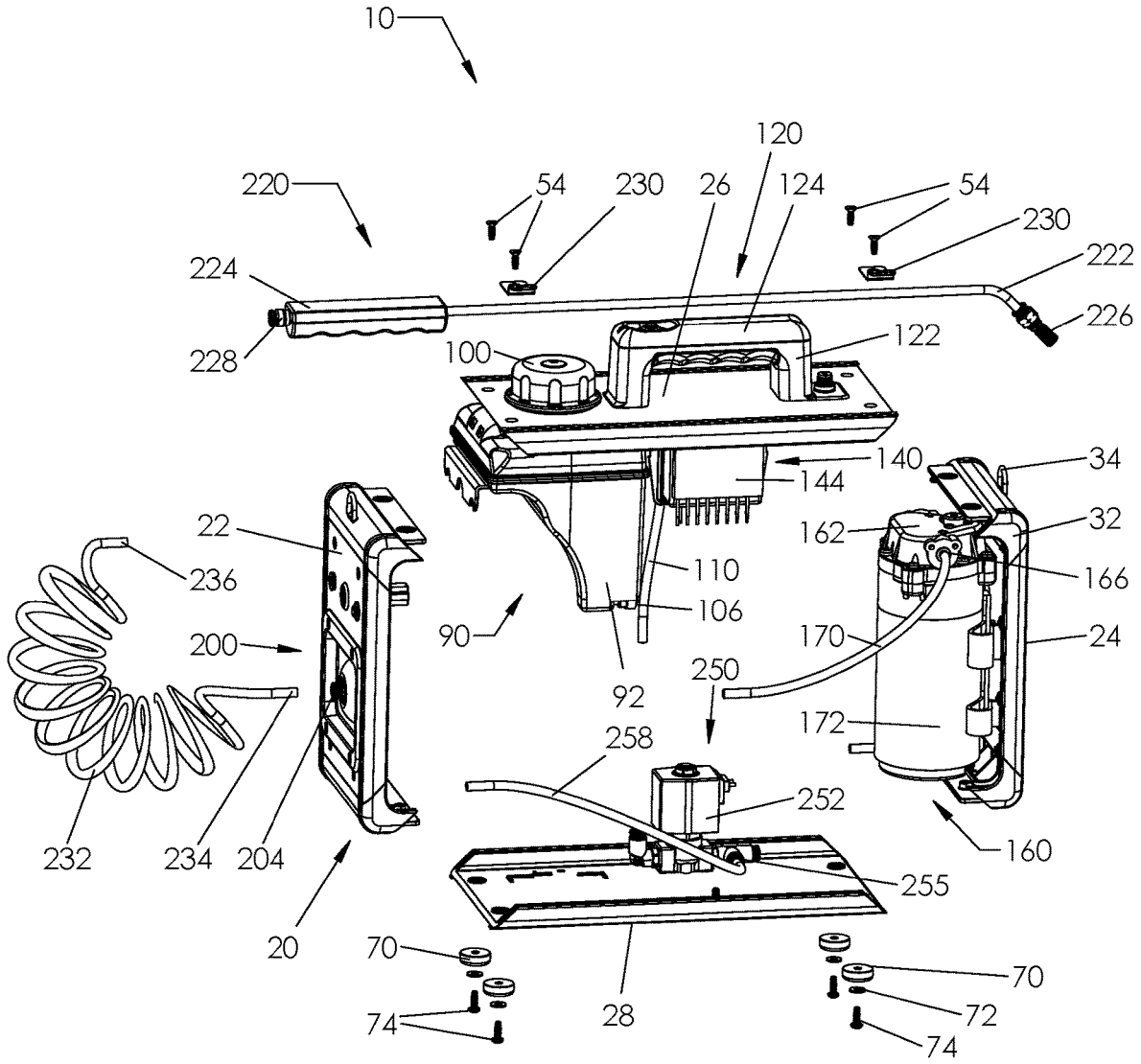
FIG. 3 is a partial exploded view of the present invention.

As seen in FIG. 3, tank assembly 90 and battery assembly 140 are secured to top panel 26. Pump motor assembly 160 is secured to rear panel 24 and solenoid assembly 250 is mounted onto bottom panel 28. Housing assembly 20 further comprises feet 70. Feet 70 are fixed to bottom panel 28 with feet washers 72 and feet screws 74. Feet screws 74 also work as corner screws, since feet screws 74 secure corresponding corners 32 to bottom panel 28. Corner screws 54 secure corners 32 on front panel 22, rear panel 24, and top panel 26.

Wand assembly 220 comprises wand tube 222, wand handle 224, wand nozzle 226, and wand tubing connector 228. Wand assembly 220 is secured onto top panel 26 with at least one wand clip 230. In a preferred embodiment, wand nozzle 226 has a single, 3×, or 5× tip, but not limited to. Wand handle 224 is assembled without screws. Wand handle 224 is joined by wand tube 222 and receives wand tubing connector 228. Wand assembly 220 connects to wand panel assembly 200 through wand tubing 232. Wand tubing 232 comprises first end 234 and second end 236, whereby first end 234 connects to bulkhead union 204 and second end 236 connects to wand tubing connector 228.

Figure 4:
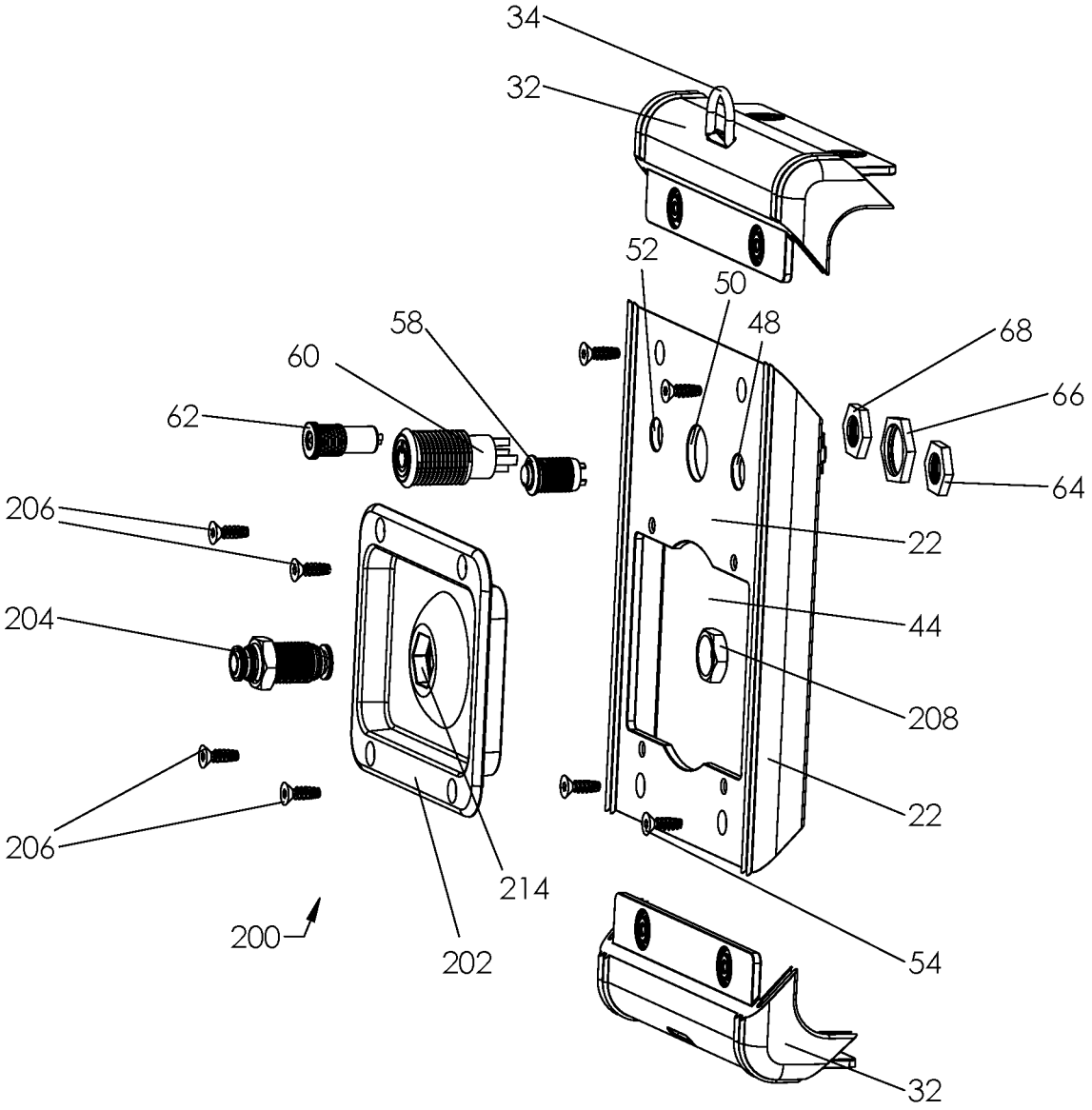
FIG. 4 is an exploded view of a front section of the present invention having a wand panel assembly.

As seen in FIG. 4, front panel 22 defines wand panel cavity 44, mix switch hole 48, power switch hole 50, and charge port hole 52. Mix switch hole 48 receives mix switch 58, power switch hole 50 receives power switch 60, and charge port hole 52 receives charge port 62. Mix switch 58, power switch 60, and charge port 62 are secured to front panel 22 with mix switch nut 64, power switch nut 66, and charge port nut 68. Mix switch 58 allows solenoid assembly 250, seen in FIG. 3, to purge the pump of air. Depressing mix switch 58 allows for in-tank mixing or re-mixing. Wand panel cavity 44 receives wand panel assembly 200. Wand panel assembly 200 comprises wand panel 202 having central hole 214 to receive bulkhead union 204 secured with bulkhead union nut 208. Wand panel 202 is fixed to front panel 22 by mounting screws 206.

Figure 5:
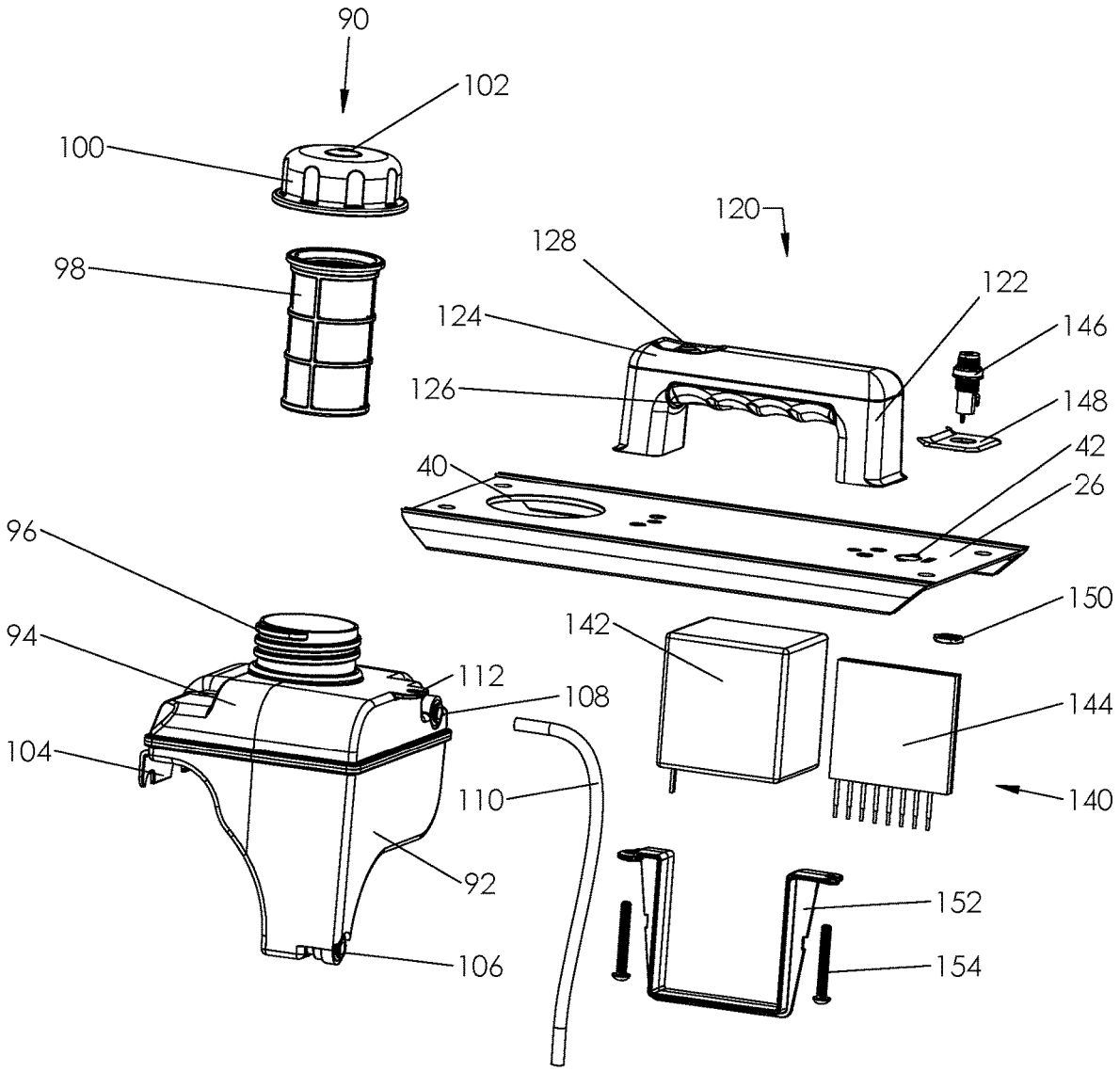
FIG. 5 is a partial exploded view of a top section of the present invention, which has a handle assembly, a tank assembly, and a battery assembly.

As seen in FIG. 5, top panel 26 comprises tank neck hole 40 and fuse hole 42. Tank assembly 90 comprises tank body 92, tank upper section 94, tank neck 96, tank strainer 98, tank cap 100 having cap vent 102, and tank mounting flange 104. Tank upper section 94 comprises tank inlet 108, which receives mix tube 110. Tank body 92 comprises tank outlet 106. Tank assembly 90 rests on mix switch 58, power switch 60, and charge port 62, seen in FIG. 4, through tank mounting flange 104, while tank neck 96 passes through tank neck hole 40 protruding from top panel 26 to receive tank cap 100. Tank assembly 90 is secured to top panel 26 through top flange 112 with mounting screws 154. Handle assembly 120 is fixed onto top panel 26. Handle assembly 120 comprises handle body 122, handle top 124, handle grip 126, and mist switch 128.

Battery assembly 140 comprises battery 142, control board 144, fuse 146, and battery mounting bracket 152. Fuse 146 passes through fuse hole 42 and protrudes from top panel 26. Fuse spacer 148 is positioned between top panel 26 and fuse 146. Fuse 146 is secured by fuse nut 150. Battery 142 comprises a battery management system. Battery 142 is charged through charge port 62, seen in FIG. 4, with a charger, not seen. Battery 142 is secured to top panel 26 by battery mounting bracket 152 and mounting screws 154. Mounting screws 154 secure tank assembly 90, battery 142, and handle assembly 120 to top panel 26. A leg of battery mounting bracket 152 and top flange 112 are fixed together to top panel 26 by mounting screws 154, which pass through top panel 26 to receive and secure handle body 122.

Figure 6:
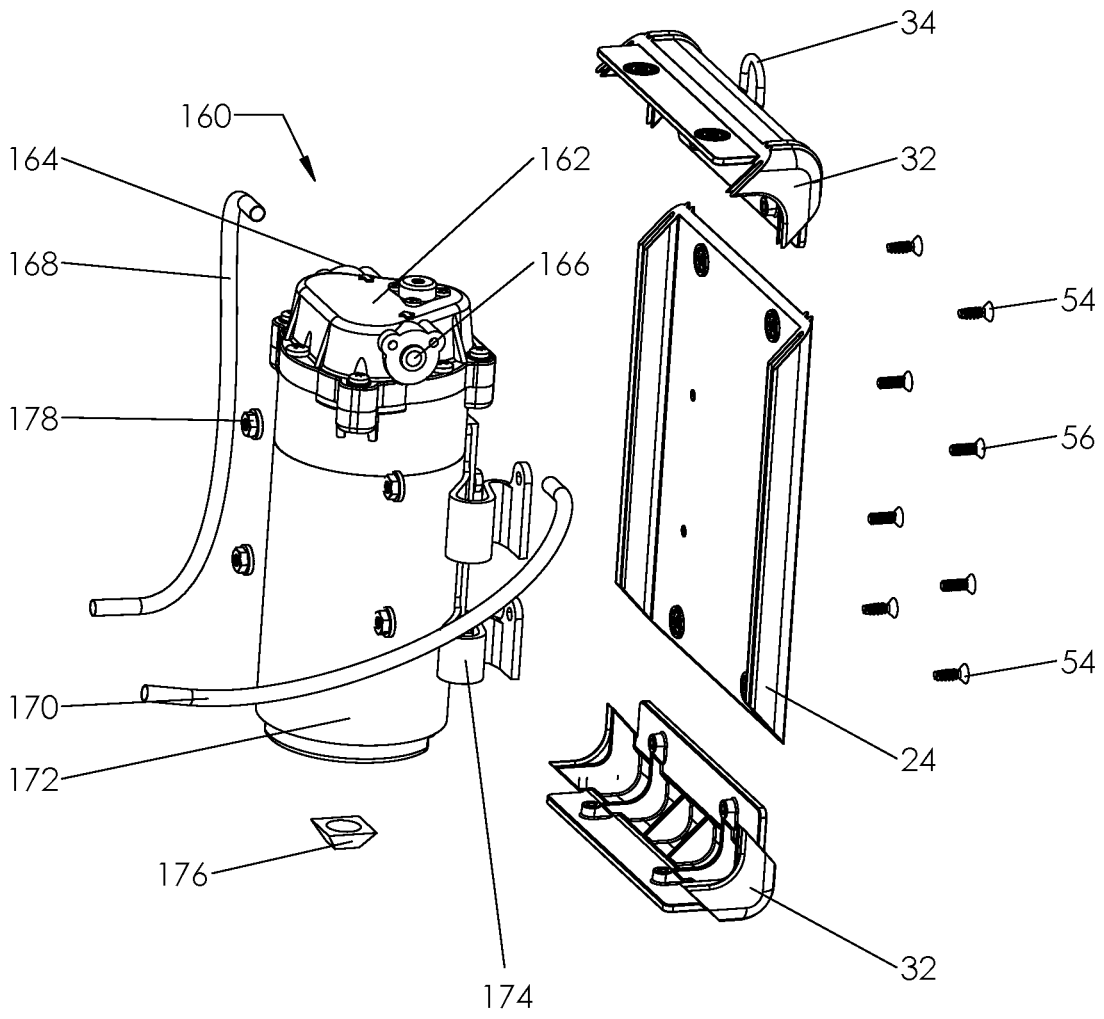
FIG. 6 is a partial exploded view of a rear section of the present invention having a pump motor assembly.

As seen in FIG. 6, pump motor assembly 160 comprises pump 162, pump output 164 to connect pump output tube 168, pump input 166 to connect pump input tube 170, and motor 172. Motor 172 is secured to rear panel 24 by motor bracket 174 with pump-motor mount screws 56 secured by pump-motor mount nuts 178. Motor spacer 176 is between motor 172 and bottom panel 28, as seen in FIG. 2B.

Figure 7:
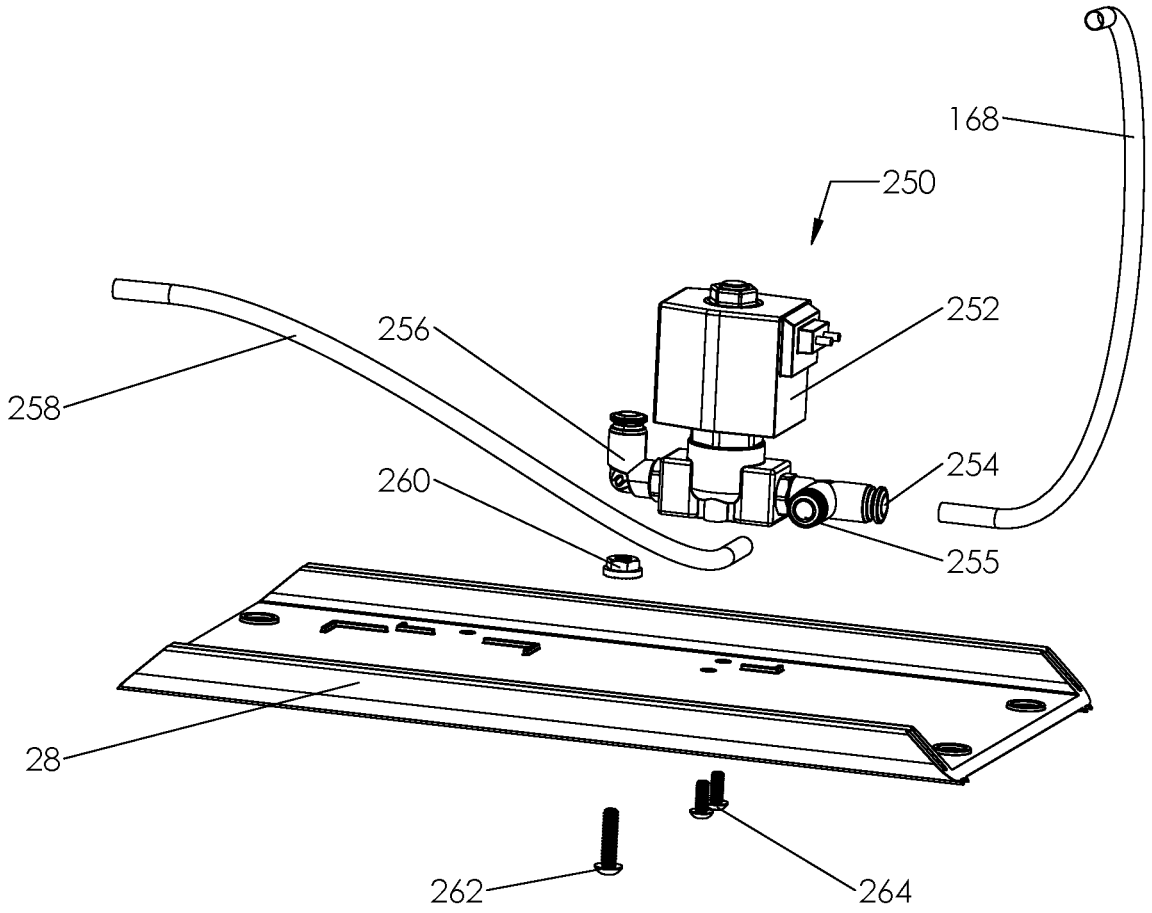
FIG. 7 is a partial exploded view of a bottom section of the present invention having a solenoid assembly.

As seen in FIG. 7, solenoid assembly 250 comprises solenoid valve 252, solenoid input connections 254 and 255, solenoid output connector 256, and main output tube 258, which is connected to solenoid input connection 255. Solenoid assembly 250 is secured onto bottom panel 28 by solenoid mounting screws 264. Solenoid assembly 250 further comprises ground bus 262 and ground bus nut 260. Solenoid input connections 254 and 255 may act as an input or output depending if solenoid assembly 250 is on or off. Pump output tube 168 connects to pump output 164, seen in FIG. 6, and to solenoid input connection 254. When solenoid valve 252 is not being used, pump output tube 168 sources main output tube 258.

Solenoid assembly 250 drops main output tube 258 pressure when misting stops upon mist switch 128, seen in FIG. 5, release allowing for dripless operation. Solenoid assembly 250 allows for a return fluid path for mixing when mix switch 58 is depressed. Solenoid assembly 250 purges the pump of air. This allows users to purge air from the pump motor assembly 160, seen in FIG. 3, so it reaches optimum pressure and by returning the purge fluid back to tank assembly 90, it prevents the alternative of misting out onto the ground.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable mist wand system, comprising:

A) a housing assembly comprising a front panel, a rear panel, a top panel, a bottom panel, and lateral panels, said front panel defining a wand panel cavity, a mix switch hole, a power switch hole, and a charge port hole, and said top panel comprises a tank neck hole and a fuse hole;

B) a tank assembly secured to said top panel and trapped by said front panel;

C) a handle assembly mounted onto said top panel;

D) a battery assembly secured onto said top panel;

E) a pump motor assembly secured to said rear panel;

F) wand panel assembly mounted onto said front panel;

G) a wand assembly; and

H) a solenoid assembly mounted onto said bottom panel, whereby said housing assembly houses said tank assembly, said battery assembly, said pump motor assembly, and said solenoid assembly.

2. The portable mist wand system set forth in claim 1, wherein said housing assembly further comprises corners, strap loops, air intake holes on said lateral panels, and feet on said bottom panel.

3. The portable mist wand system set forth in claim 1, wherein said wand panel cavity receives said wand panel assembly, said mix switch hole receives a mix switch, said power switch hole receives a power switch, and said charge port hole receives a charge port.

4. The portable mist wand system set forth in claim 3, wherein said solenoid assembly allows for a return fluid path for mixing and purge air when said mix switch is depressed.

5. The portable mist wand system set forth in claim 1, wherein said tank assembly comprises a tank body having a tank outlet, a tank upper section having a tank inlet to receive a mix tube, a tank neck, a tank strainer, a tank cap having a cap vent, a tank mounting flange, and a top flange.

6. The portable mist wand system set forth in claim 5, wherein said tank neck passes through said tank neck hole and protrudes from said top panel to receive said tank cap.

7. The portable mist wand system set forth in claim 5, wherein said handle assembly comprises a handle body, a handle top, a handle grip, and a mist switch.

8. The portable mist wand system set forth in claim 7, wherein said pump motor assembly comprises a pump, a pump output with a pump output tube, a pump input with a pump input tube, and a motor.

9. The portable mist wand system set forth in claim 8, wherein said motor is secured to said rear panel with a motor bracket, and a motor spacer is between said motor and said bottom panel.

10. The portable mist wand system set forth in claim 8, wherein said wand panel assembly comprises a wand panel having a central hole to receive a bulkhead union secured with a bulkhead union nut.

11. The portable mist wand system set forth in claim 10, wherein said wand assembly comprises a wand tube, a wand handle, a wand nozzle, wand tubing connector, a wand tubing having first and second ends, and at least one wand clip to secure said wand assembly to said top panel.

12. The portable mist wand system set forth in claim 11, wherein said wand tubing extends from said wand panel assembly to said wand assembly, whereby said first end is connected to said bulkhead union and said second end is connected to said wand tubing connector.

13. The portable mist wand system set forth in claim 10, wherein said solenoid assembly comprises a solenoid valve, first and second solenoid input connectors, a solenoid output connector, and a main output tube.

14. The portable mist wand system set forth in claim 13, wherein said solenoid assembly drops said main output tube pressure upon said mist switch release allowing for dripless operation.

15. The portable mist wand system set forth in claim 13, wherein said mix tube extends from said tank inlet to said solenoid output connector and said pump input tube extends from said tank outlet to said pump input.

16. The portable mist wand system set forth in claim 13, wherein said main output tube extends from said second solenoid input connector to said bulkhead union.

17. The portable mist wand system set forth in claim 5, wherein said battery assembly comprises a battery, a control board, a fuse, a battery mounting bracket, and mounting screws.

18. The portable mist wand system set forth in claim 17, wherein said fuse passes through said fuse hole and protrudes from said top panel.

19. The portable mist wand system set forth in claim 17, wherein said battery, said tank assembly, and said handle assembly are secured to said top panel with said mounting screws, whereby a leg of said battery mounting bracket and said top flange are fixed together to said top panel by said mounting screws.

* * * * *